US007000803B2

(12) United States Patent
Miller

(10) Patent No.: US 7,000,803 B2
(45) Date of Patent: Feb. 21, 2006

(54) CONTOURED CARTON WITH DISPENSER

(75) Inventor: Charles A. Miller, Williamsburg, OH (US)

(73) Assignee: The C.W. Zumbiel Company, Cincinnati, OH (US)

( * ) Notice: Subject to any disclaimer, the term of this patent is extended or adjusted under 35 U.S.C. 154(b) by 0 days.

(21) Appl. No.: 10/725,626

(22) Filed: Dec. 2, 2003

(65) Prior Publication Data

US 2005/0178791 A1 Aug. 18, 2005

(51) Int. Cl.
*A47F 1/04* (2006.01)

(52) U.S. Cl. ..... 221/302; 221/303; 221/305

(58) Field of Classification Search ..... 221/302, 221/303, 305, 307, 309; 229/122, 122.1, 229/240, 242; 206/427, 434
See application file for complete search history.

(56) References Cited

U.S. PATENT DOCUMENTS

| | | | | |
|---|---|---|---|---|
| 1,853,219 | A | | 4/1932 | Newton |
| 2,067,749 | A | | 1/1937 | Zimmerman et al. |
| 2,278,793 | A | | 4/1942 | Myers |
| 3,002,651 | A | | 10/1961 | Gauld |
| 3,178,242 | A | | 4/1965 | Ellis |
| 3,263,861 | A | | 8/1966 | Carr |
| 3,265,283 | A | | 8/1966 | Farquhar |
| 3,300,115 | A | * | 1/1967 | Schauer ..... 221/305 |
| 3,332,594 | A | * | 7/1967 | De Capua ..... 221/185 |
| 3,356,279 | A | | 12/1967 | Root |
| 3,540,581 | A | | 11/1970 | Koolnis |
| 3,765,527 | A | | 10/1973 | Vargo |
| 3,894,681 | A | | 7/1975 | Arneson et al. |
| 3,913,739 | A | | 10/1975 | Hennessey |
| 3,952,872 | A | | 4/1976 | Consiglio, Jr. |
| 4,000,811 | A | | 1/1977 | Hardison et al. |
| 4,214,660 | A | | 7/1980 | Hunt, Jr. |
| 4,364,509 | A | | 12/1982 | Holley, Jr. et al. |
| 4,396,143 | A | | 8/1983 | Killy |
| 4,466,536 | A | | 8/1984 | Zeitel |
| 4,582,199 | A | | 4/1986 | Schuster |
| 4,817,866 | A | | 4/1989 | Wonnacott |
| 4,974,771 | A | | 12/1990 | Lavery |
| 4,982,845 | A | | 1/1991 | Prascak et al. |
| 5,031,825 | A | | 7/1991 | Romagnoli |
| D321,134 | S | | 10/1991 | Toinet |
| 5,106,014 | A | | 4/1992 | Miller |
| 5,137,211 | A | | 8/1992 | Summer et al. |
| 5,143,252 | A | | 9/1992 | Shi |
| 5,197,656 | A | | 3/1993 | Hoell et al. |
| 5,249,681 | A | | 10/1993 | Miller |
| 5,292,059 | A | | 3/1994 | Oliff |
| 5,368,194 | A | | 11/1994 | Oliff et al. |

(Continued)

FOREIGN PATENT DOCUMENTS

| | | |
|---|---|---|
| DE | 8514718 | 8/1985 |

(Continued)

*Primary Examiner*—David H. Bollinger
(74) *Attorney, Agent, or Firm*—Wood, Herron & Evans, LLP

(57) ABSTRACT

A contoured carton has arcuate corners and includes a dispenser for dispensing articles. The carton is formed by a top wall, bottom wall, two side walls, and two end walls and includes tear lines in at least one end wall for forming the dispenser. The tear lines preferably extend into the side walls and include a finger hole to facilitate opening of the dispenser. The dispenser opening is bound by a lower retaining tab comprised from an upper portion of the arcuate corner to retain the articles in the carton until a user removes an exposed article.

6 Claims, 4 Drawing Sheets

U.S. PATENT DOCUMENTS 5,425,474 A 6/1995 Dalea et al.
5,429,681 A 7/1995 Mesenbring
5,437,407 A 8/1995 Kim
5,439,168 A 8/1995 Kim
5,482,185 A 1/1996 McNaughton
5,505,372 A 4/1996 Edson et al.
D379,759 S 6/1997 Mulry
5,722,584 A 3/1998 Fujiwara
5,775,574 A 7/1998 Whitnell
5,857,614 A 1/1999 Walsh
5,878,947 A * 3/1999 Hoy et al. ..... 229/122.1
5,881,884 A 3/1999 Podosek
6,105,854 A 8/2000 Spivey et al.
6,105,856 A 8/2000 Kakiuchi
6,155,480 A 12/2000 Botsford et al.
6,176,419 B1 1/2001 Holley, Jr.
6,244,436 B1 6/2001 Boriani et al.
6,253,930 B1 7/2001 Freidus et al.
6,273,330 B1 8/2001 Oliff et al.
6,283,293 B1 9/2001 Lingamfelter
6,386,438 B1 5/2002 Walsh et al.
6,435,351 B1 8/2002 Gibb
6,457,580 B1 10/2002 Focke et al.
6,474,469 B1 11/2002 Luton et al.
6,478,216 B1 11/2002 Wiart
6,478,219 B1 11/2002 Holley, Jr.
6,484,903 B1 11/2002 Spivey et al.
6,550,615 B1 4/2003 Lingamfelter
6,578,736 B1 6/2003 Spivey
6,669,083 B1 * 12/2003 Bates ..... 229/240
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2002/0185527 A1 12/2002 Bates

FOREIGN PATENT DOCUMENTS

EP 1038783 9/2000

* cited by examiner

CONTOURED CARTON WITH DISPENSER

FIELD OF THE INVENTION

This invention relates to cartons, and more particularly, to a carton for multiple articles such as beverage cans in which the carton has a dispenser for controlled removal of individual articles.

BACKGROUND OF THE INVENTION

Beverage packages or cartons particularly adapted for use with containers, e.g., cans, are very well known in the prior art for the marketing of beer, soft drinks or the like. The typical beverage carton packages a series of beverage cans in a matrix configuration, and is fabricated from paperboard. Often such cartons are sized to hold eight, twelve or even twenty-four beverage cans for purchase by the retail consumer at, e.g., grocery stores or specialty markets. Such paperboard cartons or beverage can packages have seen widespread commercial success in the marketplace.

The prior art beverage cartons often incorporate a dispenser system feature that allows the retail consumer to remove the beverage cans, one by one, from the carton. A number of different structural embodiments are known for this dispenser system feature. The basic dispenser system is defined by one or more of the carton's paperboard walls, and includes a flap tear out structure of some kind or another which opens the carton only partially so that one or more, but not all, of the cans may be removed in sequence as desired by the end user. Thus a carton with a dispenser that facilitates the removal of a single article from the carton at a time is desirable.

When the articles contained in the carton are cylindrical, and are disposed in the carton upon their sides (i.e., with the longitudinal axis of the cylinder being generally horizontal), such as cans, it is important that the articles be constrained such that the remaining articles do not roll out of the dispenser when one article is removed. Additionally, another important feature is that the dispenser provides easy access to the articles. Thus, a carton with a dispenser that constrains remaining articles so that they do not undesirably roll from or otherwise exit the carton when one article is removed is also desirable.

Cartons and dispensers which are aimed at satisfying at least some of these objectives are disclosed in U.S. Pat. Nos. 6,578,736 and 6,478,219, each of which is hereby incorporated by reference. Nevertheless, the cartons and associated dispensers disclosed in each of those patents each suffer from significant drawbacks. Namely, these dispensers are incorporated into box-style cartons, or cartons having squared-off corners. Because the squared-off corners are not supported by the contents of the carton, i.e., a can, the corners often become distorted or disfigured during handling from the beverage packager through the distribution channels to the retail consumer. For example, in transit, a handler typically grasps the carton along one of its corners to move the carton. This disfigurement can cause the carton dispenser, which is usually formed within a corner of the carton, to either prematurely open or improperly operate after being opened by the retail customer. The box-style carton has further drawbacks including prospective hand injury to those handling the carton due to the sharp corners in the carton. Another drawback of the box-style carton having a dispenser is that the articles tend to jostle or move within the package after being placed in the carton and the carton ends sealed due to the added clearance required for easy loading. This jostling or knocking of the articles continues while traveling through the distribution channels and eventually to the retail customer.

A contoured carton that eliminates the squared-off corners is disclosed in U.S. Pat. No. 5,197,656 issued to Hoell et al., assigned to the assignee of this invention, and hereby incorporated by reference. In particular, that patent discloses a carton having arcuate corners that are tightly wrapped around the body of corner cans of the can matrix contained in the carton. In U.S. Pat. No. 5,429,681 issued to Miller, assigned to the assignee of this invention, and hereby incorporated by reference, a dispenser for a contoured carton is disclosed. In particular, that dispenser is formed from a pair of flaps that are in the side wall panels and aligned with the end portions of a can contained in a lower corner of the carton. The flaps only expose the end portions of the can such that to remove a can, a user slides a finger into one flap and pushes the can toward the opposed flap in the longitudinal direction of the can. The user can then grab the portion of the can sticking out of the opposed side wall.

This type of dispenser, however, does not work well in a limited area, such as a refrigerator. In such an environment, it is desirable to orient the carton to stand on a surface of smaller length, such as a bottom wall as opposed to the larger side wall, to conserve space in the environment. Therefore, a dispenser disposed only in the side walls and requiring the can to move in a direction perpendicular to the side wall would not be readily accessible to the carton's user, and requires extra shelf space in the refrigerator or the like.

There is thus a need for a contoured carton for containing a plurality of articles, such as cans, having a dispenser that is readily accessible to a user when the carton is oriented to rest on its bottom surface.

SUMMARY OF THE INVENTION

This invention provides a carton having at least one arcuate corner incorporating a dispenser therein for exposing an article for removal by a user. Specifically, in one embodiment the carton comprises a top wall, a bottom wall, two side walls, and two end walls. An arcuate corner is formed in at least one end wall and the bottom wall. The carton includes a tear line through the end wall adjacent the arcuate corner to form a dispenser opening for removing articles from the carton. The upper portion of the arcuate corner bounds the dispenser opening such that the arcuate corner provides a lower restraining tab that retains one of the articles in the carton adjacent the dispenser opening until the article is removed by a user. An upper restraining tab bounding the dispenser opening is provided by a portion of the end wall adjacent the arcuate corner. The carton also includes a finger hole in communication with the tear line to aid in opening the dispenser.

In one embodiment, arcuate corners are formed from both end walls and the top and bottom walls such that all corners of the carton are arcuate and wrap around their adjacent articles. Furthermore, the carton includes apertures along the arcuate corners at the juncture of the end walls, side walls, and top and bottom walls such that portions of the articles adjacent the arcuate corners in the carton are partially exposed through the apertures. A tear line extends through one end wall and into both side walls. A finger hole is then provided in the tear line in each side wall.

To open the carton dispenser, the user simply inserts a finger into the hole(s) provided in either or both side walls and pulls outwardly tearing along the tear lines in the side wall(s). The user continues to pull outwardly tearing the tear line across the end wall, removing a portion of the end wall and side walls and thus forming the dispenser opening. The upper portion of the arcuate corner bounds the dispenser opening and acts as a lower restraining tab to keep the articles retained in the carton until removed by the user. Additionally, the lower portion of the remaining end wall bounds the dispenser opening and acts as an upper restraining tab to provide additional retaining support for the articles inside the carton. The dispenser opening exposes the end portion of the end most article along the side wall so that the user can grab the article by its ends to quickly and easily remove the article from the dispenser.

The carton as described above can be made from a carton blank having a plurality of serially connected side wall, top wall and bottom wall panels adapted to form a pair of spaced side walls, a top wall and a bottom wall of the carton. Each of these panels also includes corner flaps or end flaps projecting from each end of the panel and adapted to form end walls having arcuate corners with the top and bottom walls of the carton. To form the arcuate structure, each side wall panel of the carton blank has arcuate corners. Furthermore, the corner flaps and end flaps on each panel are not co-extensive with its respective panel but have side edges spaced from the edge of the respective panel. These gaps allow the top and bottom corner flaps to be tightly wrapped around the body of a corner article of the carton as it is assembled. Moreover, these gaps provide for apertures along the arcuate corners that partially expose portions of the corner articles when assembled.

According to the carton, package, and carton blank for packaging articles, this invention provides for a convenient and user friendly implementation of the dispenser and associated carton without the problems associated with box-style cartons or previous dispensers in contoured cartons. Namely, this invention provides a carton having a dispenser that eliminates the sharp corners of box-style cartons therefore eliminating the risk of prematurely opening the dispenser or damaging the dispenser during transit of the packaged product. Furthermore, this invention provides a carton dispenser where the carton may be oriented to stand on its bottom wall and effectively retain the articles within the carton, while permitting easy and convenient access for a user to remove an article from the dispenser.

The features and objectives of this invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
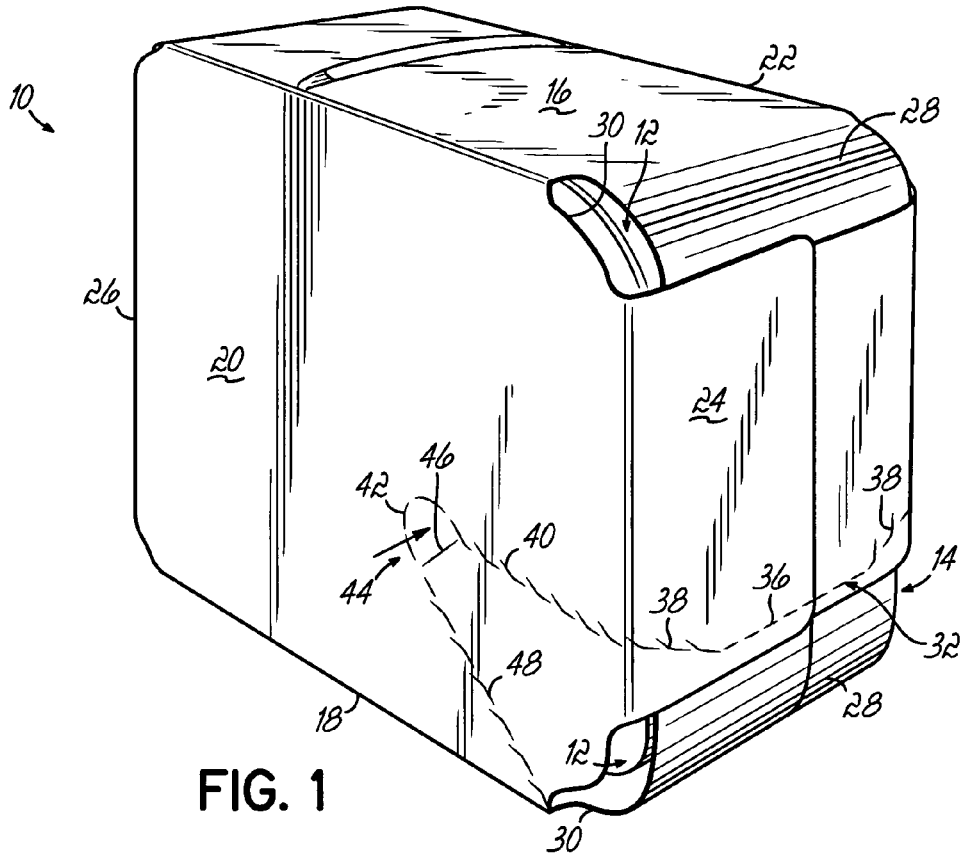
FIG. 1 is a perspective view of a carton with a dispenser in accord with the principles of this invention.

FIGS. 1–5 illustrate an embodiment of this invention. These figures show a carton 10 containing a plurality of cans 12 each having a diameter D, and a carton dispensing system 14 all in accord with the principles of this invention. Although this invention is described in terms of the articles being cans, this is by way of example and not limitation. FIG. 1 shows the carton 10 having a top wall 16, a bottom wall 18, two side walls 20, 22, and two end walls 24, 26. The carton preferably includes four arcuate corners 28 formed between the end walls 24, 26 and the adjacent top and bottom walls 16,18. The carton 10 further includes apertures 30 formed along the arcuate corners 28 each at the juncture between one of the end walls 24, 26, top and bottom walls 16,18 and one of the side walls 20, 22. The apertures 30 are configured such that the cans 12 contained inside the carton and adjacent the arcuate corners 28 are partially exposed.

Figure 5:
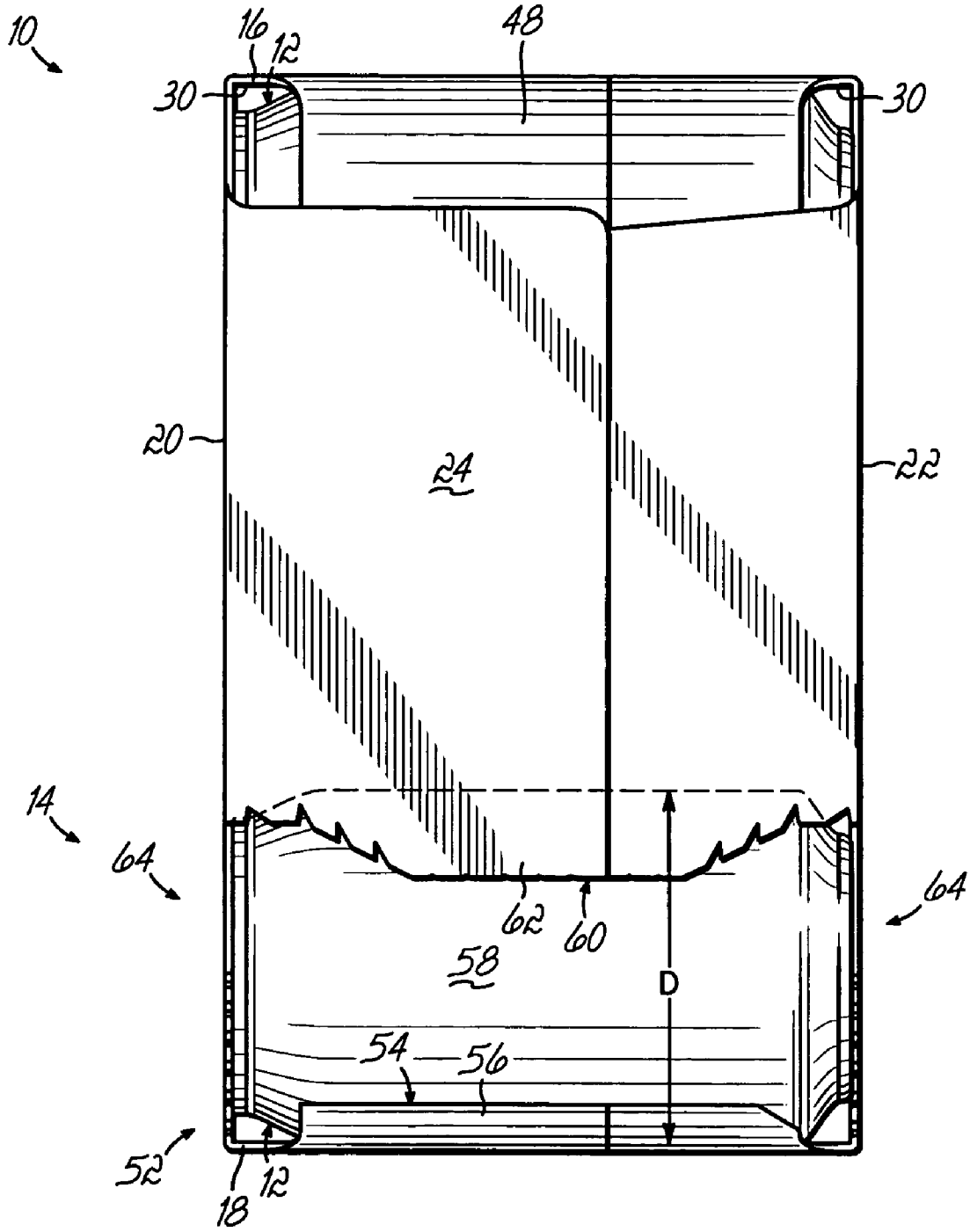
FIG. 5 is an end elevation view of a carton with the dispenser removed from the carton.

The carton 10 has a tear line 32 extending through an end wall 24 adjacent one arcuate corner 28 to form the dispenser system 14. In the shown embodiment, the tear line 32 extends into both side walls 20, 22. The tear line through the end wall 24 comprises a straight line portion 36 generally parallel to the bottom wall 18 and centered about the end wall 24. On each end of straight line portion 36 is a slanted tear line 38 directed toward the top wall 16 and extending to the juncture between the side wall 20, 22 and the associated end wall 24. The straight line portion 36 extending across the end wall 24 is at a height from the bottom wall 18 less than the diameter D of can 12 contained in carton 10 (FIG. 5). The slanted tear lines 38 each intersect the respective juncture between the side wall 20 or 22 and the end wall 24 at a height approximately equal to the diameter D of cans 12.

The tear line in the side wall 20 comprises a straight line portion 40 generally parallel to the bottom wall 18 having one end connected to the slanted tear line 38 at the juncture between the side wall 20 and the end wall 24. Tear line 40 extends through the side wall 20 for a distance approximately equal to the diameter D of cans 12. A finger hole 42 is formed from a semi-circular tear line having one end connected to tear line 40. The finger hole 42 is located at an interstitial site 44 adjacent the dispenser system 14 created by the packaging of cans 12, such that there is no can 12 or portion thereof directly behind finger hole 42. The finger hole includes fold line 46 across the semi-circular finger hole 42 to more easily accommodate a user's finger (not shown). The free end of the finger hole 42 is connected to a slanted tear line 48 extending through the side wall 20 and terminating at the juncture between the aperture 30 adjacent the dispenser system 14 and the bottom wall 18. It is to be appreciated that the tear lines in the side wall 22 (not shown) are a mirrored reflection of the tear lines in side wall 20 about the end wall 24 and could be described in a corresponding manner.

Figure 2:
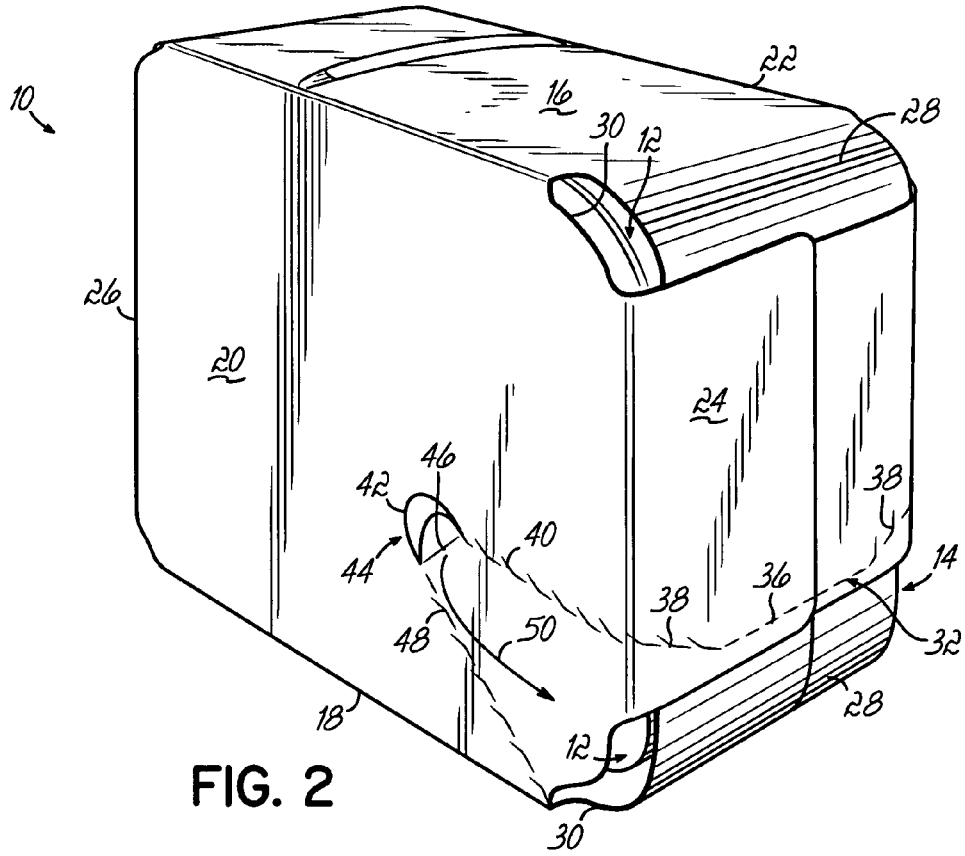
FIGS. 2–4 are perspective sequential views of the carton of FIG. 1 with the dispenser being opened for removal of the articles from the carton.
Figure 3:
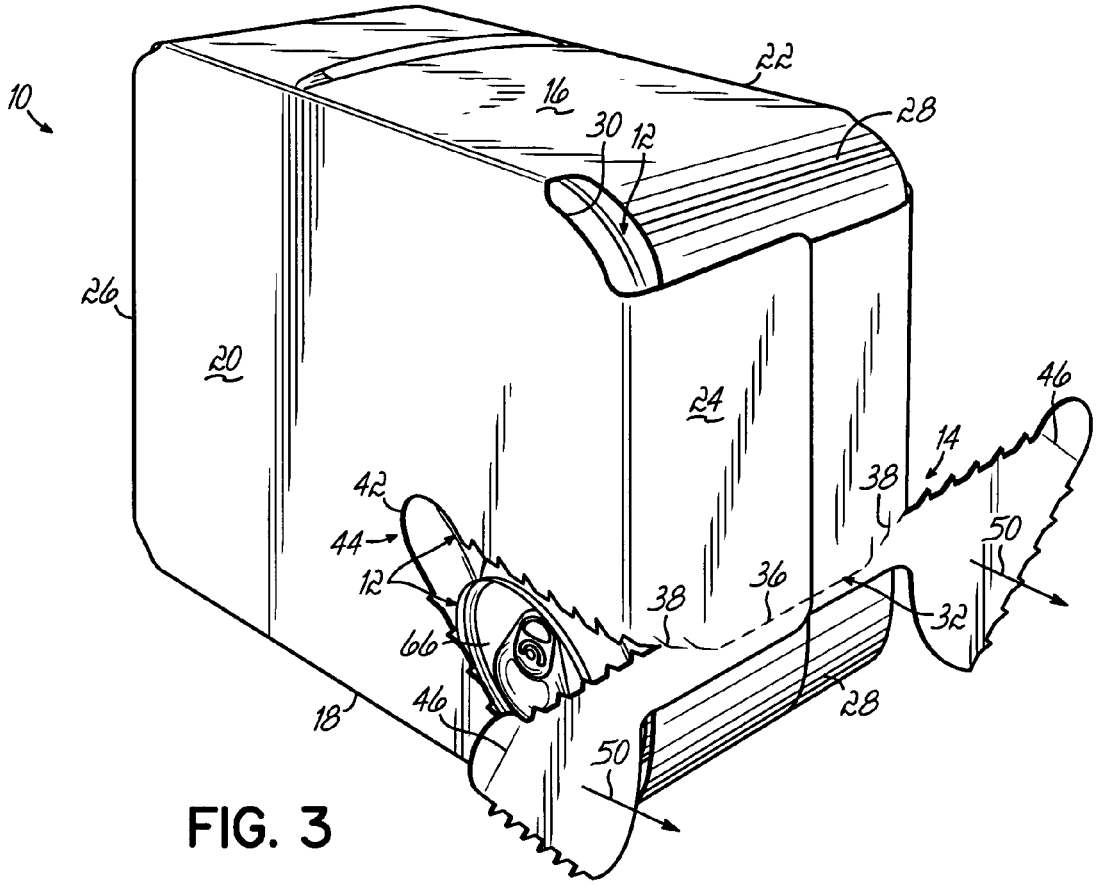

As shown in FIGS. 2–3, a user (not shown) puts a finger through finger hole 42 in side walls 20, 22 and pulls in an outward direction as indicated by the arrow 50 to open the dispenser system 14 of carton 10. The tear line tears along segments 40, 48 until the dispenser system 14 breaks free from the side wall 20, 22, as shown in FIG. 3. The user continues to pull in the outward direction 50 to tear the tear line across the end wall 24 to form the dispenser opening 52.

Figure 4:
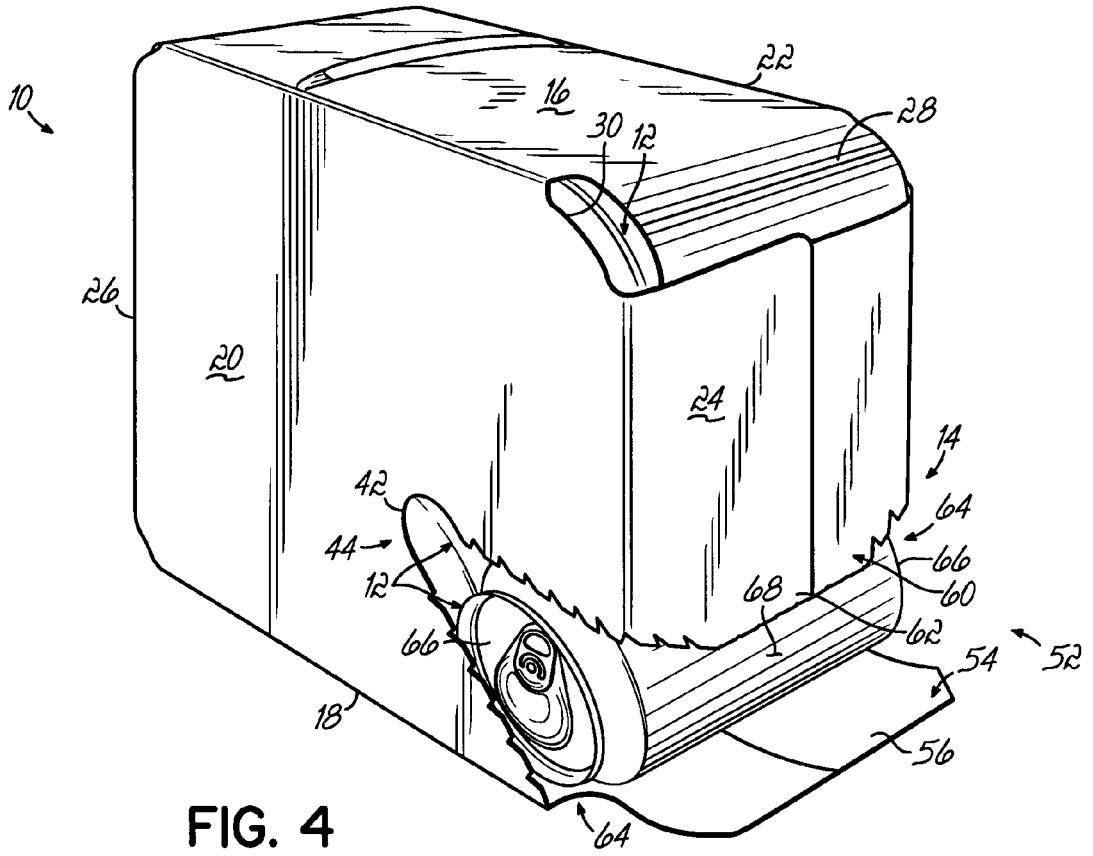

As shown in FIGS. 4–5, dispenser opening 52 is bounded by an arcuate shaped lower retaining tab 54 formed from an upper portion 56 of arcuate corner 28 that remains after the dispenser system 14 has been removed. As shown in FIG. 5, the upper portion 56 of the arcuate corner 28 is above the bottom wall 18 so as to contact the forward surface 58 of the can 12 and prevent the cans from undesirably being dispensed from the carton. Moreover, the lower retaining tab 54 is configured to retain one of the cans 12 adjacent the dispenser opening 52 in the carton 10 until a can is removed by a user. Dispenser opening 52 is further bounded by an upper retaining tab 60 formed from the lower portion 62 of the remaining end wall 24 after the dispenser system 14 has been removed from the carton. As shown in FIG. 5, the lower portion 62 of the remaining end wall 24 is at a height less than the diameter D of a can 12 adjacent the dispenser opening 52 so as to contact the forward surface 58 of can 12 to prevent the cans from being dispensed until removed by a user.

The dispenser opening is further configured to provide openings 64 on the side walls 20, 22 to facilitate the removal of cans from the dispenser. More specifically, openings 64 expose the end portions 66 of the can 12 adjacent the dispenser opening 52. In this way, a user who wants to remove a can from the dispenser would grab the can by its end portions 66, for instance, using a thumb and an index finger, and pull in an outwardly direction 50. The lower retaining tab 54 and the upper retaining tab 60 flex thereby releasing exposed can 12 from the dispenser. After one article is removed, the upper and lower tabs flex back to their initial position and shape and thus prevent other articles from inadvertently escaping through the opening 52. Providing the openings 64 allows the user to easily and conveniently remove articles from the dispenser opening 52.

Figure 6:
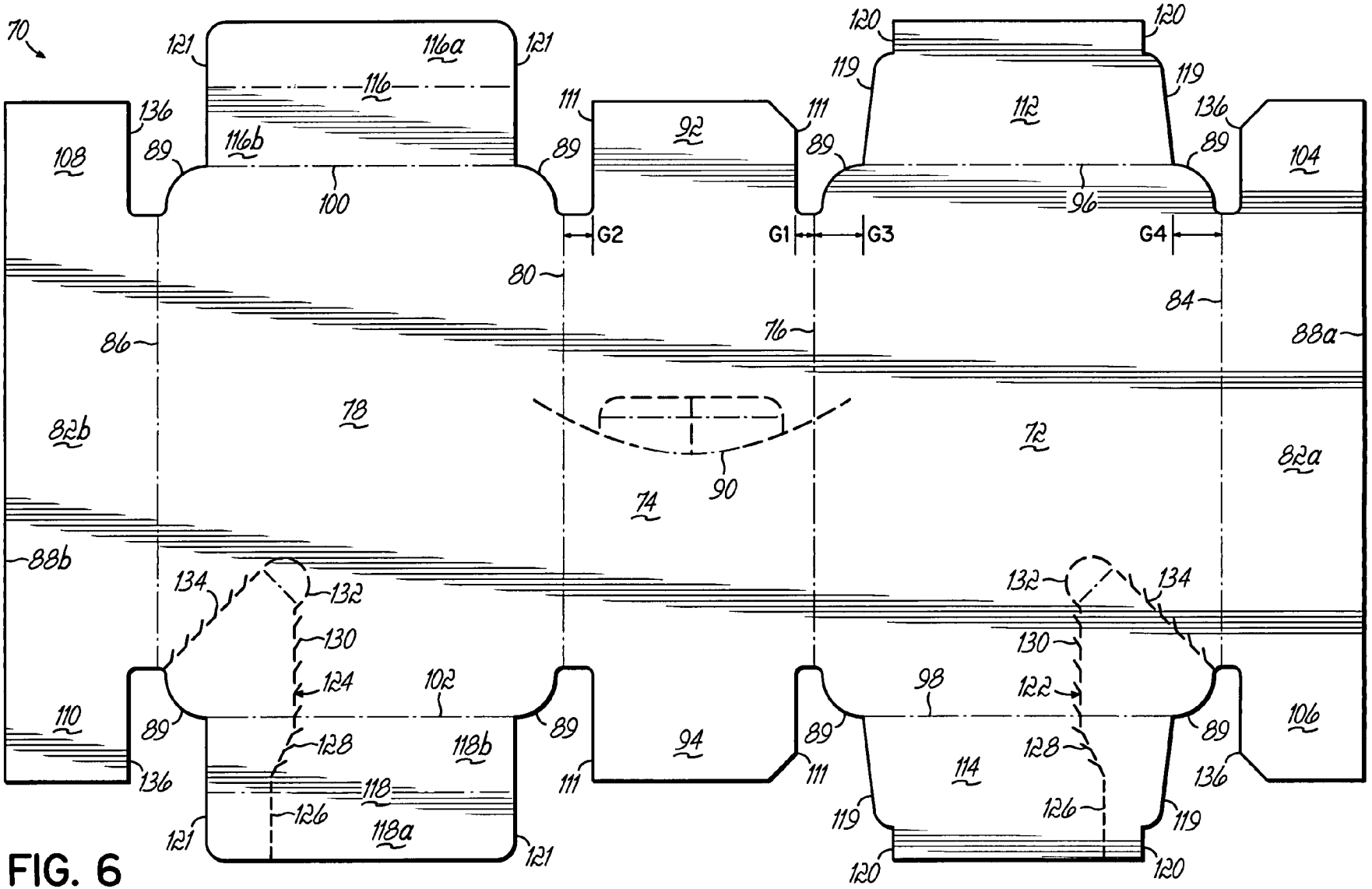
FIG. 6 is a top plan view of a carton blank for forming a carton with a dispenser in accord with the principles of this invention.

FIG. 6 shows a carton blank 70 for making the carton 10 as described above and illustrated in FIGS. 1–5. The carton blank 70 is comprised of four serially connected panels including a first side wall panel 72 having a full top wall panel 74 connected on fold line 76 to one side edge thereof. A second side wall panel 78 is connected on fold line 80 to the other edge of the full top wall panel 74. A first partial bottom wall panel 82(*a*) is connected on fold line 84 to the first side wall panel 72, and a second partial bottom wall panel 82(*b*) is connected along fold line 86 to the second side wall panel 78. It is to be understood that the cut in the blank material creating edge 88(*a*) and 88(*b*) could be located in any of the panels of the carton blank and showing it in the bottom panel 82 is not limiting in any manner. The first and second side wall panels 72, 78 have arcuate corners 89. The full top wall panel 74 includes a handle structure 90, such as the handle disclosed in U.S. Pat. No. 5,106,014 assigned to the assignee of this invention and hereby incorporated by reference.

Corner flaps 92, 94 are provided integral with each end of the full top wall panel 74, those corner flaps extending outwardly beyond the end edges 96, 98, 100, 102 of the first and second side wall panels, respectively. Also corner flaps 104, 106, 108, 110 are provided integral with each partial bottom wall panel 82(*a*), 82(*b*), respectively, those corner flaps also extending outwardly beyond the end edges 96, 98, 100, 102. Note particularly that these corner flaps are preferably integral with the top 74 and bottom 82 wall panels in that they are not separated from those panels by any score line or slit line. Alternatively, a series of generally parallel cut crease or fold lines may be provided in the corner flaps to provide them with the generally arcuate configuration shown in FIGS. 1–4. Moreover, corner flaps 92, 94, 104, 106, 108, 110 are preferably not co-extensive with their respective panels, but have side edges 111 inwardly spaced from the edge of their respective panels to form gaps G1 and G2. Accordingly, the corner flaps 92, 94, 104, 106, 108, 110 can be and are wrapped around the body of the corner cans, contained in the fully-assembled carton 10 so as to fit snugly against those cans, and thereby hold all the cans in a tight configuration in the package so as to prevent any jostling or knocking.

The carton blank 70 also includes end flaps 112, 114 that extend outwardly from the scored end edges 96, 98, respectively, of the first side wall panel 72, and end flaps 116, 118 that extend outwardly from the scored end edges 100, 102, respectively, of the second side wall panel 78. The end score lines 96, 98, 100, 102 preferably are enhanced for folding by the inclusion of spaced slits. End panels 112, 114, 116, 118 are not co-extensive with their respective panels but have side edges 119, 121 inwardly spaced from the edge of their respective panels to form gaps G3 and G4. Each second side wall end flaps 116, 118 is sub-divided into an outer fold up glue panel 116(*a*), 118(*a*) at its outer edge, and an inner locator panel 116(*b*), 118(*b*). The fold up glue panels 116(*a*) and 118(*a*) are for gluing the carton 10 together in closed package form. Each first side wall end flaps 112, 114 is provided with notched out corners 120 at its opposed outer corners to allow the second side wall end flaps 116, 118 to be glued to the corner flaps 92, 94, 104, 106, 108, 110, as well as to the first side wall end flaps 112, 114. Note particularly that side edges 119 of the first side wall end flaps 112, 114 are tapered from the fold lines 96, 98 connection with the first side wall panel 72 to the outer edge thereof, same being to ensure that the first side wall end flaps are oriented or located within the side edges of the second side wall end flaps 116, 118 when the carton 10 is glued together in final assembly form. Gaps G3 and G4 cooperate with gaps G1 and G2 for form apertures 30 contained in the fully-assembled carton 10 so as to partially expose the corner cans.

As illustrated in FIG. 6, the carton blank includes a pair of tear lines 122, 124 for forming the dispenser system 14 for assembled carton 10. The tear lines 122, 124 are formed in the end flaps 114, 118 at a selected end of carton blank 70 and extend into the first and second side wall panels 72, 78, respectively. It is to be understood that the opposed end of blank 70 could have been the selected end or both ends could have been selected ends so as to have dispensing systems in both end walls of assembled carton 10. The tear line 122 includes a vertical line segment 126 extending from an outer edge of end flap 114 and is followed by a slanted tear line 128 directed toward the top wall panel 74. This tear line terminates at scored end edge 98. The tear line 122 in first side wall panel 72 includes a vertical line 130 beginning at the scored end edge 98. A finger hole 132 is formed by a tear line having a semi-circular shape and is connected at one end to vertical line 130. The free end of finger hole 132 is connected to a slanted tear line 134 that extends to the fold line 84 between the first side wall panel and the partial bottom panel 82(*a*). Tear line 124 is similarly formed in end flap 118 and second side wall panel 78. The carton blank 70 having tear lines 122, 124 is assembled and glued as described in U.S. Pat. No. 5,197,656 to form the carton or package 10 containing a plurality of cans 12 and having a dispensing system 14 as described in FIGS. 1–5.

While this invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A blank for forming a carton for containing a plurality of similarly configured articles, the blank comprising:

serially connected side wall, top wall and bottom wall panels;

an arcuate corner flap formed integral to each end of the top and bottom wall panels;

an end flap foldably connected to each end of the side wall panels; and, a plurality of tear lines extending through the side wall end flaps and the side wall panels;

wherein the side wall, top wall and bottom wall panels are adapted to form a pair of spaced side walls, a top wall and a bottom wall of a carton, the top and bottom wall corner flaps adapted to wrap around a corner can and cooperate with the side wall end flaps to form end walls having arcuate corners with the top wall and bottom wall of the carton.

2. The blank of claim 1 wherein the side wall panels have arcuate corners.

3. The blank of claim 2 wherein the top wall and bottom wall corner flaps have side edges spaced from the side wall panels to form a first and second gap, the side wall end flaps have side edges spaced from the top wall panel and the bottom wall panel to form a third and forth gap, wherein the gaps form an aperture in each arcuate corner formed at a juncture of the end walls, side walls, top wall and bottom wall of the carton for partially exposing an article.

4. The blank of claim 1 further comprising:

a finger hole in communication with at least one tear line to facilitate commencing opening a dispenser opening defined at least in part by selected tear lines.

5. The blank of claim 1 wherein the plurality of tear lines extend into the connected side wall panels.

6. The blank of claim 1 wherein the blank is paperboard.

* * * * *